US009347727B1

(12) United States Patent
Cler

(10) Patent No.: US 9,347,727 B1
(45) Date of Patent: May 24, 2016

(54) AUTOMATIC WEAPON SUPPRESSOR

(71) Applicant: Daniel L. Cler, Coatesville, PA (US)

(72) Inventor: Daniel L. Cler, Coatesville, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/698,086

(22) Filed: Apr. 28, 2015

Related U.S. Application Data

(60) Provisional application No. 61/985,643, filed on Apr. 29, 2014.

(51) Int. Cl.
*F41A 21/00* (2006.01)
*F41A 21/30* (2006.01)

(52) U.S. Cl.
CPC ..... *F41A 21/30* (2013.01)

(58) Field of Classification Search
CPC ..... F41A 21/30
USPC ..... 89/14.4, 14.05, 14.2, 14.3; 181/223
See application file for complete search history.

(56) References Cited

U.S. PATENT DOCUMENTS 1,017,003 A * 2/1912 Kenney ..... F41A 21/30 181/223
1,990,837 A * 2/1935 Morgenstern ..... F01N 1/089 181/255
2,451,514 A * 10/1948 Sieg ..... F41A 21/28 89/14.3
3,748,956 A * 7/1973 Hubner ..... F41A 21/30 89/14.4
4,588,043 A * 5/1986 Finn ..... F41A 21/30 181/223
5,029,512 A * 7/1991 Latka ..... F41A 21/30 181/223
5,679,916 A * 10/1997 Weichert ..... F41A 21/30 181/223
6,374,718 B1 * 4/2002 Rescigno ..... F41A 21/30 89/14.4
6,575,074 B1 * 6/2003 Gaddini ..... F41A 21/34 89/14.4
7,308,967 B1 * 12/2007 Hoel ..... F41A 21/30 181/223
7,610,992 B2 * 11/2009 Brittingham ..... F41A 21/30 181/223
7,789,008 B2 * 9/2010 Petersen ..... F41A 21/30 89/14.4
7,987,944 B1 * 8/2011 Brittingham ..... F41A 21/30 181/223
8,087,338 B1 * 1/2012 Hines ..... F41A 21/36 181/223
8,1

(Continued)

*Primary Examiner* — Michelle R Clement
(74) *Attorney, Agent, or Firm* — Henry S. Goldfine

(57) ABSTRACT

A suppressor for rapid fire weapons designed to rapidly bleed down the weapon pressure and thereby minimizing gas blowback to the operator and to the weapon's gas operating system; while also creating a shear gas flow about the exiting bullet's gas flow to mask the flash thereof. The suppressor is configured within a generally cylindrical housing, having: (1) a central core of unported K-baffles located about a central bulletway; (2) a bypass located between the cylindrical housing and the unported K-baffled central core—providing a generally forward subsonic high gas flow area to an endcap closing the cylindrical housing; (3) said endcap having a series of vent ports for the bypass, which also create a shear flow about the centrally exiting bullet; and (4) wherein the series of unported K-baffles are spaced away from the weapon's bore end to allow the propellant gasses to expand into the bypass.

2 Claims, 4 Drawing Sheets

(56) References Cited

U.S. PATENT DOCUMENTS 8,100,224 B1 * 1/2012 Olson ..... F41A 21/30 181/212
8,511,425 B2 * 8/2013 Larue ..... F41A 21/30 181/223
8,579,075 B2 * 11/2013 Brittingham ..... F41A 21/30 181/223
8,739,922 B2 * 6/2014 Wirth ..... F41A 21/30 181/223
8,794,376 B2 * 8/2014 Shults ..... F41A 21/30 181/223
8,844,422 B1 * 9/2014 Klett ..... F41A 21/30 89/14.2
8,857,306 B1 * 10/2014 Edsall ..... F41A 21/30 181/223
8,910,745 B2 * 12/2014 Latka ..... F41A 21/30 181/223
8,939,057 B1 * 1/2015 Edsall ..... F41A 21/30 181/223
8,991,550 B2 * 3/2015 Coley ..... F41A 21/30 181/223
8,991,551 B2 * 3/2015 Latka ..... F41A 21/30 181/223
8,991,552 B2 * 3/2015 Latka ..... F41A 21/30 181/223
2010/0180759 A1 * 7/2010 Petersen ..... F41A 21/30 89/14.4
2012/0103176 A1 * 5/2012 Latka ..... F41A 21/30 89/14.4
2012/0272818 A1 * 11/2012 Dueck ..... F41A 21/30 89/14.4
2013/0175113 A1 * 7/2013 Hines ..... F41A 21/30 181/223
2014/0020976 A1 * 1/2014 Shults ..... F41A 21/30 181/223
2014/0318887 A1 * 10/2014 Latka ..... F41A 21/30 181/223
2015/0001002 A1 * 1/2015 Wirth ..... F41A 21/30 181/223
2015/0253099 A1 * 9/2015 Shults ..... F41A 21/30 181/223
2015/0285575 A1 * 10/2015 Sclafani ..... F41A 21/30 181/223

* cited by examiner

AUTOMATIC WEAPON SUPPRESSOR

CROSS-REFERENCE TO RELATED APPLICATIONS

This application claims the benefit of U.S. Provisional Application No. 61/985,643 filed on Apr. 29, 2014, which is incorporated herein by reference.

STATEMENT OF GOVERNMENT RIGHTS

The inventions described herein may be manufactured, used and licensed by or for the U.S. Government for U.S. Government.

BACKGROUND

1. Field of the Invention

The present invention relates to a weapon suppressor system capable of minimizing the gas backflow to the operator and to the weapon's operating system, as well as, minimizing the weapon flash—the system comprising a unique central baffle and bypass system.

2. Description of the Related Art

Firearm suppressors are designed to attach to the muzzle of a weapon and reduce the noise and flash generated by said weapon when it is fired. While there are numerous suppressor designs which may accomplish this, an issue which remains is how to accomplish this while not affecting the overall performance of the weapon, especially high rate of fire weapons such as machine guns and carbines. Typical baffle sections in most suppressors do not allow for rapid blowdown of the weapon due to supersonic flow choking effects at each baffle section. As a result the flow chokes and slows blowdown of the weapon at each section. As a result, pressure and temperature gradients form in the suppressor. This often cause slow blowdown, high pressure at the breech during weapon cycling, high pressure sections in the suppressor, which may require significant wall thickness and added weight, and higher temperatures in the high pressure sections.

Proper management of weapon blowdown is critical for several reasons. Weapon blowdown is the rate at which the weapon barrel empties the propellant gases after the projectile leaves the weapon. Suppressors, when added to a weapon typically reduce the blow down rate and increase the back pressure in the weapon. In addition they can cause an "organ pipe effect" whereby pressure waves to ring back and forth in the barrel/suppressor system.

A primary effect of the reduced blowdown is an increases in pressure at the breech during case ejection of automatic or semi-automatic weapons. Case extraction can occur within milliseconds of firing and breech pressures with a suppressor installed can be 2 to 3 orders of magnitude higher if blowdown is not properly managed. This high pressure can cause case ejection problems, propellant fouling, propellant gases in the operators face and other problems. In addition, a reduced blowdown rate can cause changes in weapon powering of either piston driven or gas tube driven weapons. The decreased blowdown rate causes the pressure at the barrel gas port to be higher for a longer period of time and hence provides more power to the gas piston or gas operating mechanism. This can cause increased bolt velocities beyond weapon design limits and potentially damage weapon parts unless pressures can be reduced at the gas port by some means.

In order to increase the blowdown rates of a weapon with a suppressor it is critical to provide good blast overpressure reduction while at the same time emptying the suppressor can as fast as possible. The critical issue with regards to blowdown management of weapon suppressors is to increase the blowdown rate while not increasing the blast overpressure levels significantly.

Low visual signature is often important as well, to reduce the ability of an enemy to visually locate a firing position. Weapon flash may be caused by unburnt propellant at high temperatures exiting the suppressor where it mixes with the outside air and ignites. Reducing this flash is desirable.

Thermal management of weapon suppressors is also critical because they tend to absorb large amounts of heat when placed on a weapon. Suppressors have much larger internal surface areas than weapon barrels and as a result can absorb more heat from the propellant gases. While some suppressors may reduce the pressure of the exiting flow by acting as a heat sink to absorb thermal energy, thereby cooling the gas and reducing its volume, this effect would rapidly diminish with each shot of an automatic weapon, where the suppressor would heat up and no longer be able to cool the gas to reduce pressure.

Thus there is a need for a suppressor which can rapidly blowdown the contained pressure when used with a rapid firing weapon, while providing good sound suppression and minimizing visual signature and effectively managing thermal energy. This is accomplished through a combination of various design features described below.

A comparison to prior art U.S. Pat. No. 8,286,750 B1—'Energy Capture and Control Device', hereafter referred to as '750, is made here.

'750 is an "energy capture and control" device. Because of the large surface area and extensive turning through the use of multiple tubes, multiple internal wall, a serpentine flow path as a method to lengthen the flow path, it is expected that this will produce a device that "dissipates energy transferred from the high energy material" to the suppressor structure. Hence the suppressor becomes a heat sink for the high temperature propellant gases. This is accomplished by both increasing the turbulence of the flow by providing multiple and aggressive turning as well as providing large surface area or large contact area with the gas to increase heat transfer to the suppressor. It has been shown that pulling heat from the gases reduces the pressure of the gases and reduces the blast overpressure. This shows that one of the primary ways this suppressor functions is through temperature reduction of the gases. The '750 design is well suited to low rate of fire weapons such as sniper rifles and potentially some carbines. Otherwise the suppressor will soon reach peak temperature and no longer provide sufficient sound reduction since the suppressor is too hot to capture energy and reduce sound. Hence it should be noted that the '750 sound suppression technique utilized is primarily temperature reduction of the gas which in turn provides a pressure reduction. It is not primarily a pressure reduction device.

The off axis flow in '750 uses a serpentine flow path. The multiple internal walls actually decrease the volume of the fluid expansion, not increase it. The volume of the wall material reduces the available expansion volume and hence reduces the pressure reduction of the suppressor which would be due to volume increase. While the internal walls of '750 do increase the flow path length by using a "radially serpentine" flow path which cases the flow to go back and forth in addition to going around the central chamber due to the helical internal wall structure, creating gas turning, increased turbulence, and high amounts of wall heat transfer, the high heat transfer rate to the wall of the prior art will only work as long as the suppressor heats up to an a reasonable operating temperature after a limited number of shots. As a result, the '750 design losses effectiveness as it heats up since it gets its suppression primarily through temperature reduction.

Further by adding four to five inner tubes to the inside of the suppressor, the additional internal surface area is significantly higher. Heat transfer is typically proportional to surface area until the gas cools sufficiently that heat transfer to the wall no longer happens. As a result, the prior art suppressor will have more total heat transferred to the suppressor per shot. In a machine gun situation, the heating rate will be higher and the final temperature after a given number of rounds should be higher.

The inner tube system also drastically reduces the effective cross-sectional area significantly. As a result, the effective cross-sectional area is likely less than the exit area of the suppressor. As a result, flow could choke at any given point along the very long flow path. This could increase blow down time. Short blowdown time is critical for machine gun suppressors. The choked flow would lead to increased back pressure and blowback in a rapid fire situation, which could blow back towards the operator and could stress and potentially damage or disrupt the operating system.

K-baffles are utilized in suppressors as discussed in the background of U.S. Pat. No. 7,987,944 'Firearm sound suppressor baffle': One typical conventional baffle is referred to as a "K-baffle," . . . . The K-baffle is generally defined by a rear plate portion that is generally flat and oriented transverse to the axial bore of the suppressor and a forward bell portion extending in a forward direction from the rear plate portion along the longitudinal axis of the K-baffle. The rear plate portion includes a central aperture for a projectile to pass through the K-baffle in the forward direction. The forward bell portion increases in annular cross-section from the central aperture and rear plate portion to a forward end, which is configured to about a rear plate portion of a subsequent K-baffle. Thus, the K-baffle defines an interior chamber within the forward bell portion and an exterior chamber between the rear plate portion and the forward bell portion outside of the forward bell portion. The interior chamber and exterior chamber is typically fluidly connected by a flow aperture cut into the forward bell portion. Consequently, a plurality of K-baffles defines a plurality of blast chambers for the burning gases to expand into during firing of the firearm, thereby reducing the noise output of a muzzle blast.

However, as the '944 patent indicates, in a K-baffle 'The interior chamber and exterior chamber is typically fluidly connected by a flow aperture cut into the forward bell portion.', such as is not the case in the subject invention. In a typical K-baffle system the flow apertures lead into side chambers which dead-end. In a rapid fire environment, this dead end would saturate with pressure and not blow down properly, leading to increased blowback, which can blow back towards the operator and could stress and potentially damage or disrupt the operating system.

SUMMARY OF THE INVENTION

A suppressor for automatic and semi-automatic weapons for rapid bleed down of weapon pressure is disclosed which may include: a baffled central chamber, configured along the bore axis, formed by a series unported K-baffles; a baffled bypass chamber, disposed surrounding the central chamber, providing a high flow area, forward directed flow path, wherein inner surface of said bypass chamber is substantially defined by the exterior shape of the unported K-baffles and which may further include a plurality of baffles such as annular rings or ported partitions. Propellant gasses may expand into the bypass chamber before the central chamber begins, and thereafter there is no fluid communication between the central and bypass chambers. The distal end of the suppressor may include a surface which includes a central chamber outlet disposed along the bore axis, and a series of perforations, surrounding the central chamber outlet, which provide outlets for the bypass chamber. The minimum flow area of the bypass chamber exceeds that of the outlet perforations such that, once the suppressor has reached steady state, the bypass flow should choke at the outlets, rather than in the bypass chamber.

The suppressor may be secured to a distal end of a barrel of a weapon and may be formed to have a body portion, or 'can', having a bore extending concentric with a bore axis of the barrel when the suppressor is attached to the distal end of the barrel. The suppressor includes a central chamber, configured along the bore axis, which utilizes a multiple chamber unported K-baffle system to reduce the primary blast wave strength. A K-baffle system is typically a plurality of frustoconical segments arranged in series and connected by annular rings creating a baffle chamber. The K-baffle of the subject invention is 'unported' in that it does not have typical apertures which would allow fluid communication between the interior and exterior.

This K-baffle system temporarily chokes the flow in each section, and thereby reduces the primary blast wave strength by approximately 52% at each nozzle. Over a half dozen nozzles, this can theoretically reduce the pressure to 2% of its original pressure.

A baffled bypass chamber may be located around the central chamber, where the inner surface of said bypass chamber is substantially defined by the exterior shape of the unported K-baffle and which may further include a plurality of baffles disposed substantially perpendicular to the bore axis, and which may take the form of annular rings or ported partitions, and where the fluid path defined by the baffled bypass chamber proceed substantially forward.

Within the proximal end of the can interior there may be a primary chamber, which provides for fluid communication between the inlet and both the central chamber and the bypass chamber, which allows a portion of the expanding propellant gasses to flow into the bypass chamber. After the central core chamber begins, it is no longer in fluid communication with the bypass chamber and the fluid paths proceed separately within the suppressor.

The distal end of the suppressor may include a surface, which may be a cap attached to the distal end of the can, which includes a core chamber outlet disposed along the bore axis, and a series of perforations, surrounding the core chamber outlet, which provide outlets for the bypass chamber.

The bypass flow moves essentially forward, with no reversals, and the amount of undulation of the flow is reduced to only the amount required to time the exit and control the pressure of the blast waves. Because of the shorter flow path of the by-pass flow, it exits at nearly the same time or before the core or central flow exits. This is not the case in the prior art technology where it is significantly delayed with the serpentine flow path. The timing of this flow is critical.

Because the bypass flow exits at the same time or before the central flow, the bypass flow of the subject invention is able to shield the central core flow as it exits. If the perforations which serve as the bypass chamber exits are positioned close to the exit nozzle of the core, the flow from the end cap may provide a shear layer interaction between the core flow and by-pass flow. The by-pass flow then shields the core flow from oxygen in the surrounding atmosphere and reduces flash by extinguishing flash started in the suppressor core by starving it of oxygen for first round flash. Reducing first round flash is critical for suppression technology as this is often as much of a locater as sound.

Compressible flow theory shows that only one choke point can exist in a given system during steady state flow. Granted a suppressor is not a steady state flow device, it soon reaches near steady-state conditions with 1-2 milliseconds after bullet exit and during the majority of the barrel blow down. Hence one needs to design the entire flow path and carefully control the areas to fix the choke point.

The bypass of an embodiment of the subject invention should be designed such that the choke point occurs at the exit holes. In order to achieve this, all of the upstream areas need to be greater than this final area. In order to ensure this is the case, a general rule that the minimum upstream cross-sectional area be a minimum of 2 to 3 times the exit area, to ensure that the flow is subsonic (Mach 0.3 to 0.5) in order to account for any flow inefficiencies or turning that could cause an effective decrease in flow area. This bypass system allow for rapid bleed down of the final pressure remaining in the weapon.

An added benefit of the bypass flow choke point occurring at the exit holes, is that the flow can be adjusted and optimized to trade-off suppression vs weapon blowback by changing the total exit area, which is the sum of the bypass exit area and the center channel exit area. By reducing the exit area for the optimized suppressor, lower sound can be achieved at the expense of higher blowback and higher weapon overpowering. This allows more control over optimization of the suppressor. The total exit area may be expressed as by the ratio of total exit area of the suppressor to weapon bore area. A total exit area to bore area ratio in the range of 1.5 to 5 is optimum. The exit area can be divided between the core throat area and the by-pass exit area.

Thermal management of weapon suppressors is also critical because they tend to absorb large amounts of heat when placed on a weapon. Suppressors have much larger internal surface areas than weapon barrels and as a result can absorb more heat from the propellant gases. While some suppressors may reduce the pressure of the exiting flow by acting as a heat sink to absorb thermal energy, thereby cooling the gas and reducing its volume, Thermal management is addressed by subject invention by maintaining a low internal surface area to reduce heat transfer from the gas to the suppressor, and controls the sound through reduction and control of the pressure, not by reducing the temperature of the gas flow, as may be found in the prior art. The subject invention achieves this, in part, by its use of a more direct bypass gas flow path than is seen in the prior art, which eliminates reversals and has minimal undulations along its forward pathing. Non-reliance on heat sink effect for suppression is critical to an automatic weapon suppressor, as the usefulness of a heat sink effect would rapidly diminish with each shot of an automatic weapon, where the suppressor would heat up and no longer be able to cool the gas to reduce pressure.

DETAILED DESCRIPTION

Note that the terms 'central chamber', 'core chamber' and 'central core chamber' are used interchangeably.

Figure 1A:
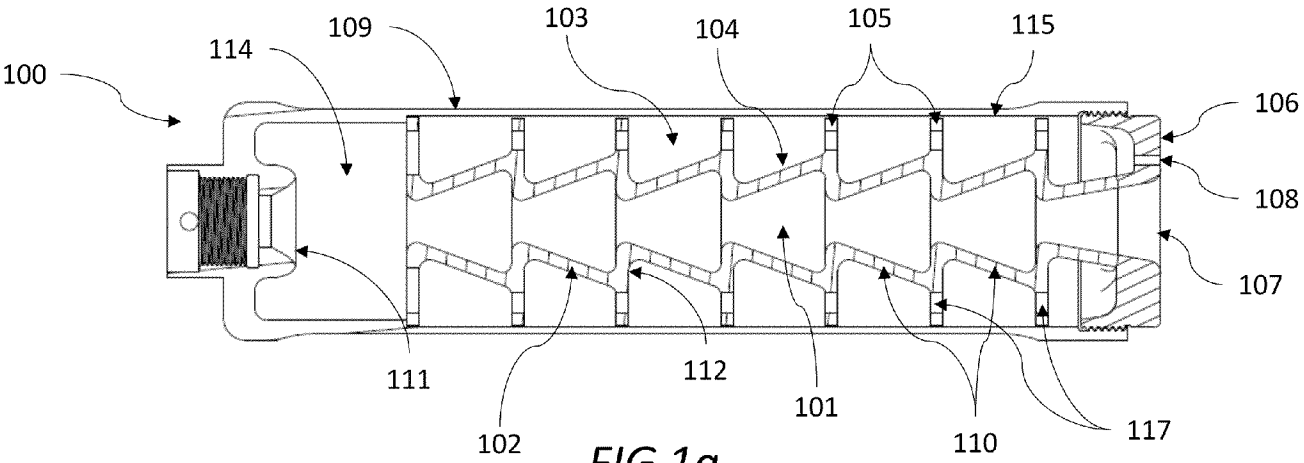
FIG. 1*a*. is a cross-sectional side view of a device having an unported K-baffle system forming a central chamber, surrounded by a baffled bypass chamber with ported partition baffles in accordance with an example of the subject invention.

As shown in FIG. 1*a*, suppressor [100] for automatic and semi-automatic weapons for rapid bleed down of weapon pressure, according to an embodiment of the subject invention, may include: a baffled central chamber [101], configured along the bore axis, formed by a series unported K-baffles [102]; a baffled bypass chamber [103], disposed surrounding the central chamber [101], providing a high flow area, forward directed flow path, wherein inner surface [104] of said bypass chamber [103] is substantially defined by the exterior shape of the unported K-baffle system [102] and which may further include a plurality of baffles [105, 113] such as annular rings or ported [117] partitions [105]. Propellant gasses may expand into the bypass chamber [103] before the central chamber [101] begins, and thereafter there is no fluid communication between the central [101] and bypass chambers [103]. The distal end of the suppressor [100] may include a surface, which may be disposed on a cap [106] attached to the distal end of the suppressor [101] which includes a central chamber outlet [107] disposed along the bore axis, and a series of perforations [108], surrounding the central chamber outlet [107], which provide outlets for the bypass chamber. The minimum flow area of the bypass chamber [103] exceeds that of the outlet perforations [108] such that, once the suppressor [100] has reached steady state, the bypass flow should choke at the outlet perforations [108], rather than in the bypass chamber [103].

The suppressor may be secured to a distal end of a barrel of a weapon and may be formed to have a body portion [109], or 'can', having a bore extending concentric with a bore axis of the barrel when the suppressor is attached to the distal end of the barrel. The suppressor includes a central chamber [101], configured along the bore axis, which utilizes a multiple chamber unported K-baffle system [102] to reduce the primary blast wave strength.

A K-baffle system [102] is in the shape of a series of frustoconical sections [110], axially aligned with the bore axis, identically oriented, with their large diameter at the distal end with respect to the inlet [111], and with the small diameter end of a subsequent frustoconical section joined to the large diameter end of a preceding section via annular rings [112], leaving a baffled central channel along the central axis.

While a typical K-baffle has ports or apertures along its body allowing fluid communication between the interior and the exterior, in the subject design, the unported K-baffle system [102] does not have such ports or apertures and there is no fluid communication between the interior and the exterior of the K-baffle system along its length. This unported K-baffle system [102] temporarily chokes the flow in each section, and thereby reduces the primary blast wave strength by approximately 52% at each nozzle. Over a half dozen nozzles, this can theoretically reduce the pressure to 2% of its original pressure.

The bore of the unported K-baffle system [102] should may have a minimum diameter which is greater than the bore of the weapon, and thus greater than the diameter of the bullets traveling there though, in part to minimize the chance of the said bullet striking the interior of the suppressor. The exterior of the K-baffle system is of a smaller maximum diameter than the inner surface of the can.

Figure 1C:
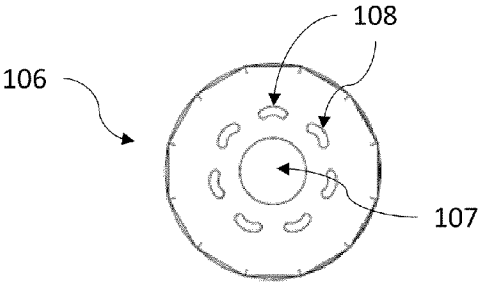
FIG. 1*c*. is an end on view of a the distal end of the embodiment of the suppressor of FIG. 1*a*, showing the cap which may be attached to the distal end of the can, which includes a central chamber outlet and a series of perforations of a kidney bean shape in accordance with an example of the subject invention.
Figure 1B:
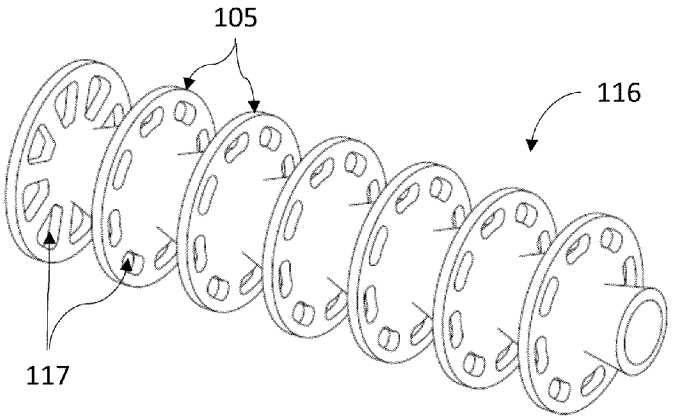
FIG. 1*b*. is a perspective view of the ported partition baffles of the bypass chamber and the K-baffle system may be fabricated as a single component in accordance with an example of the subject invention.

A baffled bypass chamber [103] may be located around the central core, where the inner surface [104] of said bypass chamber is substantially defined by the exterior shape of the unported K-baffle system [102] and which may further include a plurality of baffles [105, 113] disposed substantially perpendicular to the bore axis, and which may take the form of annular rings [113] or ported partitions [105], and where the fluid path defined by the baffled bypass chamber proceed substantially forward. These baffles may be coplanar with the annular rings of the unported K-baffle system [102], as shown in the embodiment of FIGS. 1*a* and 1*b*, or their planes may longitudinally located at the frustoconical sections. In one embodiment, the unported partition baffles of the bypass chamber and the K-baffle system may be fabricated as a single component [116] as shown in FIG. 1*b*, which may be contained within the can [109], as depicted in FIG. 1*a*.

Figure 2:
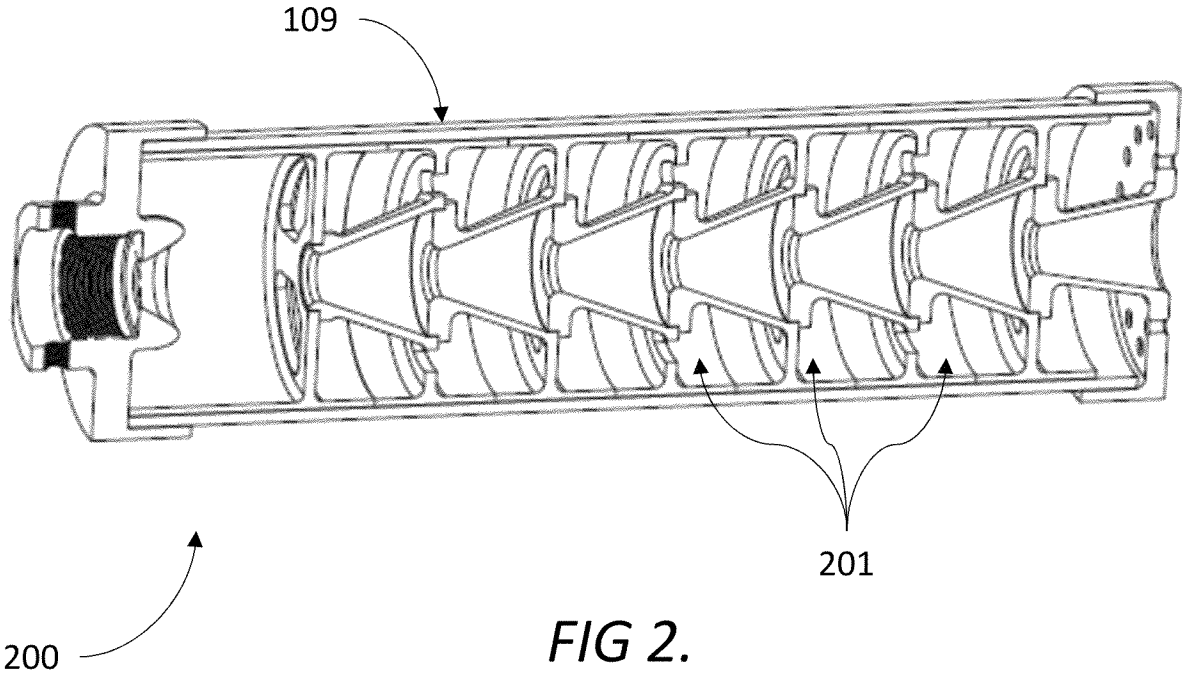
FIG. 2. is a cross sectional perspective view of an alternate embodiment may have a series of separately fabricated sections, each section substantially comprised of a chamber of the unported K-baffle system and the adjacent bypass baffle, arranged in series within the can, forming the uninterrupted central flow path of the unported K-baffle system.

An alternate embodiment [200] as shown in FIG. 2, may have a series of separately fabricated sections [201], which may be machined parts, where each section substantially comprises a chamber of the unported K-baffle system, perhaps together with an adjacent bypass baffle, and whereby a series of these fabricated sections are arranged in series within the can, and seat and seal with the adjacent sections, forming the uninterrupted central flow path of the unported K-baffle system.

Figure 3:
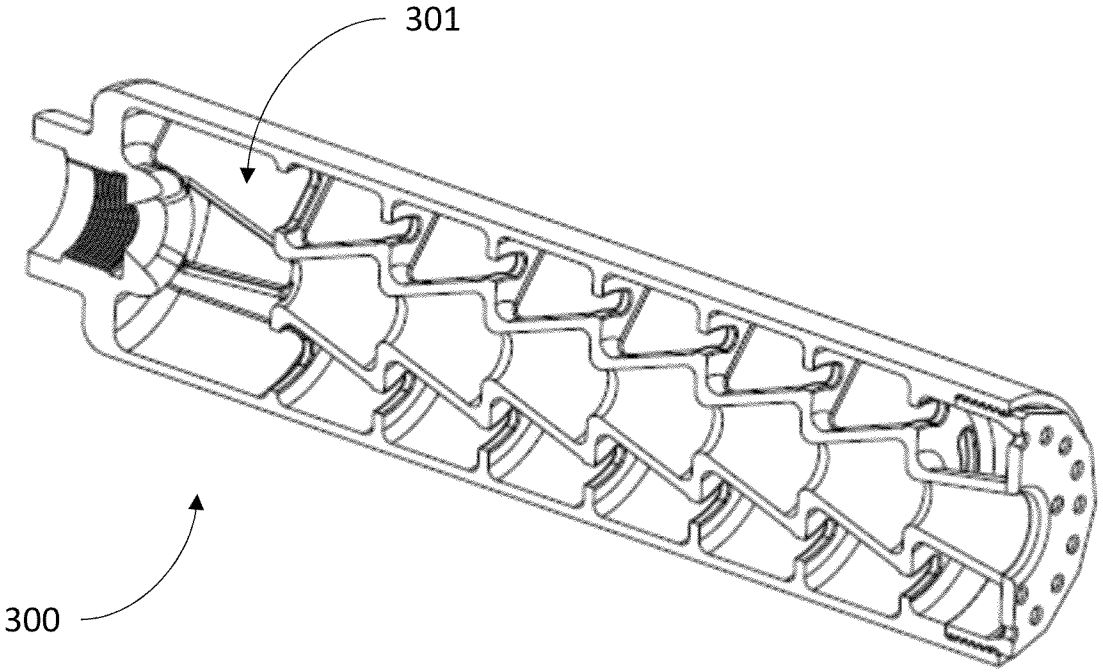
FIG. 3. is a cross sectional perspective view of yet another embodiment, wherein substantially the entire structure, which includes the unported K-baffle system, the bypass baffles, the can, proximal end inlet, and longitudinal ribs are cast as one component. The distal end surface containing the central outlet and bypass perforations is depicted as a separately fabricated endcap.

In yet another embodiment [300], as shown in FIG. 3, substantially the entire structure, which may include the unported K-baffle system, the bypass baffles, the can, and proximal end inlet, may be cast as one component, using, for instance, an investment casting process, such as lost wax casting. While the distal end surface containing the central outlet and bypass perforations may be included in the single casting, or may be fabricated separately, and attached.

Figure 4A:
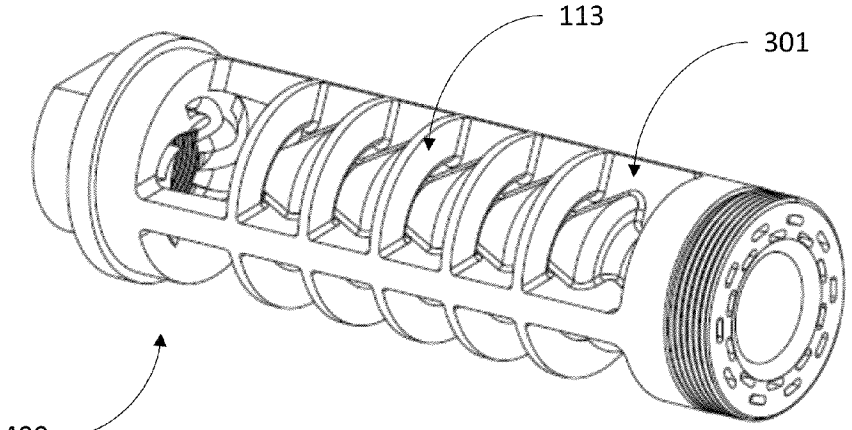
FIG. 4*a*. is a perspective view of the another embodiment of the invention, where substantially all of the interior components, including the unported K-baffle system, annular ring bypass baffles proximal surface, distal surface and longitudinal ribs having been fabricated as a single piece.
Figure 4B:
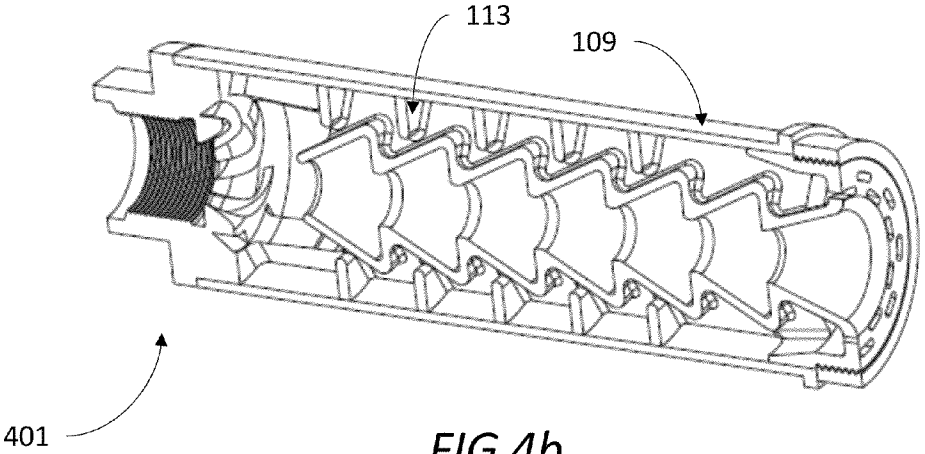
FIG. 4*b*. is a cross sectional perspective view of the embodiment of FIG. 4*a*., with the single piece fabrication of the interior components contained within the can.

In yet another embodiment [400, 401], as shown in FIG. 4*a* and FIG. 4*b*. substantially all of the interior components, including the unported K-baffle system, annular ring bypass baffles [113], proximal surface, distal surface and longitudinal ribs [301] having been fabricated as a single piece [400], depicted in FIG. 4*a*. This single piece fabrication of the interior components is then contained in the can [109], as depicted in FIG. 4*b*.

There may be a distance within the can between the suppressor inlet [111] at the distal end of the barrel and the proximal end of the central core chamber [101], said space provided by said distance may be referred to as the primary chamber [114], and which space provides for fluid communication between the inlet [111] and both the central chamber [101] and the bypass chamber [103], which allows a portion of the expanding propellant gasses to flow into the bypass chamber [103]. After the central core chamber [101] begins, it is no longer in fluid communication with the bypass chamber [103] and the fluid paths proceed separately within the suppressor.

The unported K-baffle system [102] may be structurally maintained in position along the center axis by either the baffles of the bypass channel, should they be of a ported partition baffle [105] type, which may extend from the can inner surface [115] to the unported K-baffle system [102], or by longitudinal ribs [301], which may divide the bypass chamber [103] and possibly a portion of the primary chamber radially. Longitudinal supports, running substantially parallel to the bypass flow path, will have negligible effect on the flow, and the aggregate flow of the now radially separated bypass chambers may be treated similarly to a single undivided bypass chamber [103]. The thickness and heat conductivity of such features which may be in communication with both the unported K-baffle system [102] and the external body 'can' [109], will affect their capacity for thermal conduction from the unported K-baffle system [102] to the exterior of the body. As such, it may be advantageous to construct these features to be slightly thicker and of a material that conducts the thermal energy (around 20 W/m-K) outward to the exterior to be dissipated, rather than absorbing it. However, there is a tradeoff regarding the thickness of these structures, as wall volume should otherwise be minimized in order to increase the expansion volume to the maximum allowable.

The distal end of the suppressor may include a distal surface, which may be comprised of a cap [106] attached to the distal end of the can [109], which includes a central chamber outlet [107] disposed along the bore axis, and a series of perforations [108], surrounding the central chamber outlet [107], which provide outlets for the bypass chamber. These perforations may be circular or may be oblong, substantially of an arc, or kidney bean shape [108], as shown in FIG. 1*c*.

The bypass flow moves essentially forward, with no reversals, and the amount of undulation of the flow is reduced to only the amount required to time the exit and control the pressure of the blast waves. Because of the shorter flow path of the by-pass flow, it exits at nearly the same time as the core or central flow. This is not the case in the prior art technology where it is significantly delayed with the serpentine flow path. The timing of this flow is critical.

Because the bypass flow exits at nearly the same time as the central flow, the bypass flow of the subject invention is able to shield the central core flow as it exits. If the perforations [108] which serve as the bypass chamber exits are positioned close to the center chamber outlet [107], the flow from the perforations [108] may provide a shear layer interaction between the core flow and bypass flow. The bypass flow then shields the core flow from oxygen in the surrounding atmosphere and reduce flash by extinguishing core flow flash and starving it from oxygen. Reducing first round flash is critical for suppression technology as this is often as much of a locater as sound.

The subject invention provides for control of the off axis flow. Because suppressors operate in the "compressible flow regime" aerodynamically, the control of cross-sectional areas perpendicular to the flow path is critical. Compressible flow theory shows that only one choke point can exist in a given system during steady state flow. Granted a suppressor is not a steady state flow device, it soon reaches near steady-state conditions with 1-2 milliseconds after bullet exit and during the majority of the barrel blow down. Hence one needs to design the entire flow path and carefully control the areas to fix the choke point.

The bypass chamber [103] of an embodiment of the subject invention should be designed such that the choke point occurs at the exit holes. In order to achieve this, all of the upstream areas need to be greater than this final area. In order to ensure this is the case, a general rule that the minimum upstream cross-sectional area be a minimum of 2 to 3 times the exit area, to ensure that the flow is subsonic (Mach 0.3 to 0.5) in order to account for any flow inefficiencies or undulation that could cause an effective decrease in flow area. This bypass system allow for rapid bleed down of the final pressure remaining in the weapon.

The in bypass designs with extreme turning, such as in the prior art, it would be very difficult to oversize the cross-section sufficiently to account for effective reductions in cross-sectional area. Hence, the flow could choke at any place along the flow path but likely well upstream of the exit. What this does is significantly reduce the flow rate through the suppressor and reduce the time to empty the gun barrel of gas. This is critical in machine gun applications where firing rates are close to 12 to 14 bullets per minute.

An added benefit of the bypass flow choke point occurring at the exit holes, is that the flow can be adjusted and optimized to trade-off suppression vs weapon blowback by changing the total exit area, which is the sum of the bypass exit area and the center channel exit area. By reducing the exit area at the optimized suppressor lower sound can be achieved at the expense of higher blowback and higher weapon overpowering. This allows more control over optimization of the suppressor. The total exit area may be expressed as by the ratio of total exit area of the suppressor to weapon bore area. A total exit area to bore area ratio in the range of 1.5 to 5 is optimum. The exit area can be divided between the core throat area and the by-pass exit area.

Thermal management of weapon suppressors is also critical because they tend to absorb large amounts of heat when placed on a weapon. Suppressors have much larger internal surface areas than weapon barrels and as a result can absorb more heat from the propellant gases. While some suppressors may reduce the pressure of the exiting flow by acting as a heat sink to absorb thermal energy, thereby cooling the gas and reducing its volume, Thermal management is addressed by subject invention by maintaining a low internal surface area to reduce heat transfer from the gas to the suppressor, and controls the sound through reduction and control of the pressure, not by reducing the temperature of the gas flow, as may be found in the prior art. The subject invention achieves this, in part, by its use of a more direct bypass gas flow path than is seen in the prior art, which eliminates reversals and has minimal undulations along its forward pathing. Non-reliance a heat sink effect for suppression is critical to an automatic weapon suppressor, as the usefulness of a heat sink effect would rapidly diminish with each shot of an automatic weapon, where the suppressor would heat up and no longer be able to cool the gas to reduce pressure.

The invention claimed is:

1. A suppressor for use with a firearm, the suppressor adapted to be secured to a distal end of a barrel of the firearm, coaxial with a bore axis of the firearm, the suppressor comprising:

a) An outer can of a cylindrical shape having a proximal can end, which proximal can end is adjacent to the distal end of said barrel, a distal can end opposed to said proximal can end, an interior can diameter, an interior can surface, and a central axis which is coaxial with the bore axis;

b) Wherein said proximal can end includes an inlet aperture located about the central axis, whereby there are means by which the proximal can end is secured to the barrel;

c) Wherein the suppressor further comprises a central chamber configured along the central axis, which is defined by an interior of a plurality of unported K-baffles;

d) Wherein said plurality of unported k-baffles are comprised of a series of frustoconical segments, and an annular ring segments arranged alternatingly and coaxially with each other and with the central axis;

e) Wherein each of said frustoconical segments has a large diameter end and a small diameter end, the large diameter end being partially closed by a thin annular ring which extends from the outer diameter of said large diameter end to an interior annular circle which is coaxial with said central axis;

f) Wherein a first frustoconical segment is oriented on the central axis so that its small diameter end is proximal to the inlet aperture, and is separated from the inlet aperture by an offset distance along the central axis;

g) whereby the small diameter end of each subsequent frustoconical segment is in communication with the interior annular circle of the annular ring of the preceding frustoconical segment, such that the series of frustoconical segments form an uninterrupted central structure which defines a central chamber gas flow path, and is of a length sufficient that said central chamber gas flow path extends substantially to the distal can end;

h) wherein the frustoconical segment which is substantially located at the distal can end seats and seals against a circular end cap, which circular end cap includes a central circular outlet which is coaxial with said central axis and provides an exit for the central chamber gas flow path;

i) Wherein the large diameter ends of the frustoconical segments are of a smaller diameter than the interior can diameter;

j) Wherein the unported K-baffles has an exterior of the unported K-baffles, which, in combination with the interior can surface substantially defines a bypass chamber;

k) A series of an bypass baffles within the bypass chamber, oriented perpendicular with respect to the central axis, whereby the exterior of the unported K-baffles, the interior can surface, and the bypass baffles define a bypass flow path, where the bypass flow path has a minimum bypass flow cross sectional area;

l) Wherein the inlet aperture is in fluid communication with both the central chamber and the bypass chamber, for the length of the offset distance;

m) Whereby there is no fluid communication between the central chamber and the bypass chamber beyond the offset distance or along the length of the unported K-baffles;

n) A circular end cap which may be mated with the distal can end which includes a central circular outlet disposed about the central axis which is in close communication with the distal K-baffle end and which central outlet provides an exit for the central chamber flow path;

o) Wherein the circular end cap is further comprised of a series of perforations, which surround the central circular outlet, which provide outlets for the bypass flow path, and where the aggregate area of the perforations defines a bypass exit cross sectional flow area;

p) Wherein the minimum ratio of the minimum bypass flow cross sectional area to the bypass exit cross sectional flow area is 2:1.

2. A suppressor of claim 1, further comprising:

a) a circle formed by said smaller diameter of said frustoconical segments defines a core throat area;

b) wherein said core throat area and said bypass exit cross sectional flow area taken in aggregate, provide a total exit area;

c) wherein the barrel of the firearm of a caliber has a bore diameter;

d) wherein said bore diameter provides a bore area;

e) wherein said total exit area to bore area ration is within the range of 1.5 to 5.

* * * * *